United States Patent [19]

Massari, Jr. et al.

[11] Patent Number: 4,688,710

[45] Date of Patent: Aug. 25, 1987

[54] MODULAR TOOL HAVING INTERCHANGEABLE HANDLE AND MAGAZINE UNITS

[75] Inventors: Donald J. Massari, Jr.; Robert J. Hail, both of Cincinnati, Ohio

[73] Assignee: Senco Products, Inc., Cincinnati, Ohio

[21] Appl. No.: 679,533

[22] Filed: Dec. 7, 1984

[51] Int. Cl.[4] ..... B25C 1/04; B25C 1/18; B25C 5/06; B25C 7/00

[52] U.S. Cl. ..... 227/109; 227/8; 227/120; 227/123; 227/125; 227/128; 227/130

[58] Field of Search ..... 227/109, 120, 130

[56] References Cited

U.S. PATENT DOCUMENTS

| | | | |
|---|---|---|---|
| 3,035,268 | 5/1962 | Goldring | 227/130 X |
| 3,037,207 | 6/1962 | Pazan | 227/109 |
| 3,672,029 | 6/1972 | Butriss | 227/130 |
| 4,011,785 | 3/1977 | Schrepferman | 227/130 X |
| 4,033,499 | 7/1977 | Butler | 227/120 |
| 4,511,074 | 4/1985 | Kille et al. | 227/109 X |

*Primary Examiner*—Howard N. Goldberg
*Assistant Examiner*—Taylor J. Ross
*Attorney, Agent, or Firm*—Wood, Herron & Evans

[57] ABSTRACT

A modular tool functions to drive nails or staples. The tool uses a common air motor and housing and has interchangeable magazines and handle assemblies for nails and staples, respectively. Improvements in the air motor cylinder sleeve, the firing valve, the remote valve, the trigger, the stapler follower motor and magazine, the drive station access door and latch for both stapler and nailer, the nailer magazine and follower, and other features are included.

5 Claims, 15 Drawing Figures

MODULAR TOOL HAVING INTERCHANGEABLE HANDLE AND MAGAZINE UNITS

This invention relates to tools for applying fasteners and more particularly to pneumatic tools for driving fasteners such as staples and nails.

In the manufacture of pneumatic stapling and nailing tools, it is typical to provide housings for such tools in the form of integral castings defining the cylinder body and integral handle therefor. Such castings are then machined and fitted out to provide a nailer or a stapler, as the case may be.

Typical nailers have nail magazines which are not perpendicular to the cylinder body and to the nail driver or drive axis, but rather intersect the axis at an angle less than 90° and, for example, lying in the range of about 30° to 45° from the perpendicular to the drive axis. The rear end of the magazine intersects, and is secured to, the rear end of the nailer handle for support. The handle intersects the cylinder body at an angle of less than 90° and about 5° to 20° from the perpendicular to the drive axis.

Thus, in a typical nailer, both handle and magazine extend upwardly from the horizontal when the drive axis of the cylinder is disposed vertically over a horizontal surface in which a nail is to be driven. Of course, this relationship is constant for any disposition of the nailing surface. The magazine and handle extend away from such surface to provide both a comfortable feel for the user in handling the nailer, clearer visual access to the nailing surface, and maneuverability of the nailer with respect to the surface.

On the other hand, pneumatic stapler tools typically take on a different configuration. The staple magazine is generally disposed perpendicularly to the tool drive axis, as is the handle. A bracket secures the rear end of the staple magazine to the rear end of the handle for support.

Accordingly, in the manufacture of pneumatic tools for driving fasteners, it is common to produce one form of integral casting for nailers and another form of integral casting for staplers to accommodate these varying configurations.

The magazines of each of such nailers and staplers are usually associated with welded-up backing plates, particularly designed in the respective tools for nail or staple magazines. Varying front plates are provided on the tools for cooperation with the respective welded-up back plates to define a driver path and a drive station for receiving a nail or a staple for subsequent driving. These plates vary significantly from nailer to stapler in view of the varying configuration of the tools and the fasteners.

These various considerations and configurations require the tool manufacturer to separately manufacture and inventory nailers and staplers, and parts therefor, most of which are not interchangeable. Users of both staplers and nailers must purchase completely separate tools for each function, and must inventory separate repair parts for each type tool.

Accordingly, it has been one objective of this invention to provide an improved pneumatic tool having modular construction and having both nailing and stapling capability with common interchangeable drive parts.

A further objective of the invention has been to provide an air motor and housing for interchangeable use in staplers and nailers.

A further objective of the invention has been to provide a pneumatic drive unit for interchangeable use with staple magazines and nail magazines, accommodating them in their normal respective dispositions and inclinations.

A further objective of the invention has been to provide an improved air motor for fastener driving tools.

In certain nailing and stapling applications, it is desirable to provide a plurality of nailers or staplers in a single "gang" mount for simultaneously driving a plurality of fasteners. Where it is desired to use common nailers or staplers for this, it is sometimes necessary to devise special mounting apparatus and hardware in order to mount the integral housing and handle castings. Frequently, such specialized mountings lack desired precision.

Accordingly, it has been a further objective of the invention to provide improved fastener driving apparatus for staplers and nailers which can be gang mounted to a high degree of precision.

In pneumatic fastener driving apparatus, it is common to provide a cylinder sleeve within a cylinder housing and to provide one way vents in such sleeve to permit exhaustion of air from below the descending piston and to prevent leakage of air into the cylinder above a descended piston. Such one way vents generally included a circumferential groove around the cylinder sleeve and in communication with ports extending into the cylinder sleeve from the groove. An O-ring in the groove sealed the ports against incoming air, but expanded to permit air to excape through the ports from the cylinder sleeve.

It is known to mold the sleeve with split molds moving radially inwardly for molding and then radially outwardly for releasing the sleeve. This mold motion was necessary in view of the requirement for a circumferential O-ring groove in the sleeve. Such radial motion molds, however, lacked precision as to the "roundness" of the sleeves so formed and machining of the sleeve bore was required.

Accordingly, it has been a further objective of the invention to provide a cylinder sleeve and one way sleeve vents which require either no, or substantially reduced, machining for roundness.

A further objective of the invention has been to provide an improved one-way vent and seal for a cylinder in a pneumatic fastener driving tool.

In pneumatic fastener driving tools, it is common to actuate a remote control valve with a manually operated safety trigger. Such triggers are typically pivotally mounted to the tool handle by means of rolled pins, or the like, include a safety mechanism, and are difficult to remove for servicing of the remote valve which is actuated by the trigger. Moreover, such triggers generally require manufacturing operations of extensive drilling and machining of housing or handle parts in order to accommodate and mount them.

Accordingly, it has been a further objective of the invention to provide a pneumatic fastener driving tool having an improved safety trigger which is releasably secured within the tool, and can be manually detached therefrom.

Pneumatic fastener driver tools typically include a cylinder sleeve and a firing valve member sealing against the cylinder top until moved away for pressurizing the cylinder above the piston for fastener driving. Occasionally, the seating action will cause chipping of the cylinder top and potentially undesirable pressure leakage. Also, it has been observed that the cylinder sleeve tends to shift or lift up in the tool housing, despite peripheral sealing.

Accordingly, it has been a further objective of the invention to provide an improved pneumatic fastener driver tool and apparatus preventing cylinder sleeve top end damage and wear, and for eliminating cylinder sleeve shifting.

Pneumatically driven nailers frequently incorporate nail magazines provided with a back plate for attaching the magazine to the nailer and providing a transition path for the nail from the magazine to a position from which it can be driven. Such back plates are usually welded-up constructions or weldments requiring one or more welding operations in its manufacture.

It has been a further objective of the invention to provide a fastener driving tool and magazine with a back plate member which does not require welding in the manufacturing or assembly stages.

In fastener driving tools, fastener magazines are typically provided with a fastener follower which is driven to push the line of fasteners through the magazine to a drive station. Typically, constant force type coiled springs comprising elongated steel bands are attached to a follower and are uncoiled and extended outwardly of the spring housing when the follower is pulled to the rear of a line of fasteners. Such exposure renders the spring band more susceptible to corrosion and contamination which could eventually stop or substantially diminish the necessary spring action.

It has been a further objective of the invention to provide a fastener driving tool with an improved drive motor for a fastener magazine follower.

A further objective of the invention has been to provide a fastener driving tool with a nonexposed spring driven motor for biasing magazine held fasteners therein.

In many known stapling devices, staples are loaded from a rear end of the staple magazine. This is accommodated by removal of a spring loaded follower device from the magazine. In these staplers, the magazine is generally completely closed to avoid undesired movement of the staples from a predetermined path. Staples are thus generally loaded from the rear end rather than the top of the magazine, in order to avoid open top magazines which may permit staples to fall out if that stapler is inverted. Such devices have several disadvantages, including enclosure of the magazine making it difficult to observe the number of remaining staples, and the possible loss or awkward handling of the spring-loaded follower.

Accordingly, a further objective of the invention has been to provide improved staple magazines which can be loaded without removal of the staple follower, which provides improved visual access, and which can be top-loaded without the disadvantage of potential staple displacement when the stapler is inverted.

In a nailing magazine, it is also usual to provide a follower for urging nails through a path to a drive station. Generally, such follower must be retracted rearwardly from the magazine to clear the path for nail loading. In other configurations, the follower is moved transversely at a forward end of the path, nails are loaded, and the follower pulled through an adjacent path, along the newly loaded nail strip, until a spring urges it into the nail path at a rearward end of the newly loaded nail strip.

Such a transversely moving follower has the disadvantage that it may be displaced when the last nail to be driven is in the drive station. This nail could then tilt out of place or fall backwardly into the magazine, producing a jam or a nail-less firing operation. Such nail must be cleared prior to further loading.

Accordingly, it is a further objective of the invention to provide a nail follower which positively holds the last nail to be driven in a proper position in a drive station, yet at the same time does not have to be removed rearwardly from the magazine for nail loading.

Fastener driving tools typically include a fastener driving station disposed at the forward end of the fastener magazine and defined by a forward plate and a backing plate. The fastener is urged to this station from the magazine and is engaged in this station by a fastener driver. The driver moves in a path also defined by the forward plate and backing plate.

Occasionally, a fastener driving operation will result in a jam, due to misalignment of a fastener in the drive station, improper driver/fastener contact or the engagement by the fastener of an impenetrable object.

Fastener tools are generally provided with access doors in the forward plates. These doors open to provide access to the drive station for jam clearance. It is important to secure such doors as positively as possible, yet retain easy opening for access. Also, it is desirable to secure the doors as tightly as possible to define a driving station of precise predetermined dimension, yet permit easy selective access thereto. In certain prior constructions, such doors are loosely latched, or wear into a loose condition, destroying the desired interal tolerances and leading to further jams and operational problems.

It has been a further objective of the invention to provide an improved latching apparatus for an access door to the drive station of a fastener driving tool.

In pneumatically driven fastener driving tools, it is common to use a piston movable in a cylinder and a firing valve for selectively pressurizing the area over the piston and driving it downwardly in the cylinder. One such suitable firing valve is disclosed in the copending application of John P. Crutcher, filed June 13, 1983, Appln. Ser. No. 503,843.

Such a firing valve has a nut or retainer mounted on the valve stem for retaining the appropriate seals and members of the firing valve thereon. Such a nut is typically threaded onto the stem during assembly of the tool. It has been desirable to provide an improved retainer which is easily assembled and secured to the valve stem and at reduced cost.

It has been a further objective of the invention to provide an improved firing valve retainer for mounting to a firing valve stem and securing seals and firing valve components thereon, but without requiring the machining of threads for assembly.

In pneumatic fastener driving tools, driver pistons are typically disposed in cylinders beneath firing valves controlled by remote trigger operated valves. Tool handle castings are typically machined to accept such remote valves and their respective seals. Such seals are generally of the O-ring type and require specially machined surfaces for sealing.

It has been a further objective of the invention to provide a remote valve for a pneumatic fastener tool, the remote valve having an improved sealing configuration and not requiring special machining of the handle or body into which the valve is mounted.

To these ends, a preferred embodiment of a pneumatic fastener tool according to the invention includes a modular pneumatic tool having selected common components and other separable components for selectively providing both nailing and stapling capabilities. The tool includes, as common components, an air motor, a housing, and a bottom adapter plate for receiving either a nail or a staple magazine. Separately attachable to the tool are respective main handle and magazine assemblies, one for stapling and one for nailing. The nailer handle and magazine are configured as in a normal nailer to accept standard inclined nail strips, while the staple handle and magazine are disposed at different inclinations as in a normal stapler. A trigger apparatus, safety, and remote valve apparatus are identical for each of the nailing and stapling configurations of the tool. These can be provided as a part of each handle and magazine assembly, or can be interchanged between respective handle and magazine assemblies.

The common air motor is provided with a number of unique features combining to produce not only a motive apparatus for a modular fastener tool, but an improved air motor for fastener tools. First, the cylinder sleeve is provided with a one way vent beneath the descending piston, the vent including cylinder ports and a flat elastic band of material encircling the smooth, outer cylinder sleeve surface and covering the ports. Projections from the band extend into recesses in the cylinder sleeve to insure that the band will not slip axially. This band permits air beneath a descending piston to escape from the ports, yet prevents any air from leaking into the cylinder sleeve, thus insuring positive piston return.

Such a vent eliminates the use of O-ring seals and their required circumferential sealing grooves. Since no circumferential groove is used, it is no longer necessary to use radially opened molds in making the cylinder sleeves. Instead, longitudinally movable molds can be used. These molds provide better initial roundness and thus significant cylinder sleeve machining costs are eliminated.

A cylinder sleeve retainer is disposed over and around the top of the cylinder sleeve. This retainer orients the cylinder sleeve top, serves as a top seal, cylinder sleeve chipping by the firing valve, and prevents the cylinder sleeve from shifting or rising in the housing.

The firing valve of the air motor is provided with a retainer or exhaust valve which need not be threaded to the valve stem. Instead, the retainer is provided with an inwardly tapering collar which is pressed over the stem and snaps into recesses located in the stem to secure the retainer thereto and the firing valve components together.

A trigger apparatus is mounted in a mounting plate of each handle and magazine assembly. Such mounting plate extends upwardly to a flange for securing the handle and magazine assembly to the air motor housing A trigger lever extends outwardly to selectively engage a remote valve disposed in the handle and operatively connected to the tool. The trigger includes a manually operable trigger lever, a safety interlock lever pivoted to the trigger lever and a latchable retainer or trigger cover which is snap-fit into an opening in the forward plate to releasably secure the trigger therein. The cover can be manually unsnapped to fully release the trigger from the plate, thereby rendering open and easy access to the remote valve, while retaining the safety interlock function when the trigger is in place.

A safety is also mounted on the mounting plate and is extended downwardly to a position below any magazine and tool structure. Only when the safety is pushed upwardly to engage the trigger interlock lever can the remote valve of the tool be operated and the tool activated. A rear end member of the safety is thus moved upwardly to engage the unpivoted end of the interlock lever and to raise it so that operation of the trigger can actuate the stem of the remote valve. If the safety is not pushed up by a surface against which the tool is applied, the interlock lever is not raised, and the remote valve stem will not be moved when the trigger lever is pivoted.

Each magazine, whether for nails or for staples, is provided with forward and back plates releasably securable to the bottom adapter plate of the air motor. The forward plate is provided with an access door secured with an over-center latch apparatus including a bight portion and a tapered cam latch surface. The bight and tapered surface combine to provide a positive, constant tension latch which will not loosen, and will wear in to always maintain the door positively locked in a precise position. The associated back plate comprises a portion of the respective magazine and is weldless.

The stapler magazine is provided with an improved motor for driving a staple follower. This motor includes a pulley and a coiled spring motor within the pulley. Cable is wrapped around the pulley and attached to the forward end of the magazine. When the follower is pulled rearwardly, the cable turns the pulley, winding up the internal spring and storing energy for pushing the follower forwardly. Accordingly, the follower is self-propelled and it is not required to expose an elongated flat constant force spring component outside a wound spring housing at the front of the magazine, as has been done in the past.

Moreover, the stapler magazine is provided with a pivotable cover, cammed aside from the staple magazine rail when the follower motor is pulled rearwardly for top loading of staples. When released, the follower moves forwardly against the staples and the cover pivots back over the staples to hold them from displacement even if the tool is inverted.

The remote valve in each handle comprises a housing, an insert, a stem and a spacer. The stem and spacer, together with appropriate seals, are disposed within the housing and the insert is loaded against the stem spring pressure and seal resilience to a predetermined snap-in position, effectively sealing the stem and the operative pressure passages within the housing. The housing is provided with O-ring seals and is threaded into the handle, whereby the entire remote valve and pneumatic control circuit is effectively sealed without any special machining of the handle, or of the internal surfaces of the valve housing.

When the remote valve is in place, a port at the rear end of the insert connects pressurized air in the handle to a stem bore in the insert. Pressurized air is conducted around the stem and through a port in the spacer to a housing port which is disposed in communication with a port in the handle. That latter port communicates pressurized air to the firing valve to keep it closed until the remote valve is activated by the trigger.

Upon actuation of the trigger, the remote valve stem is pushed upwardly, venting the housing port through a stem recess and disconnecting pressure air from the firing valve by means of a stem seal, all to activate the tool.

It will be appreciated that the tool provides these and many other advantages. By way of example, it is only necessary to manufacture one air motor for both staple and nail tools, the tools making use of common and interchangeable parts. This facilitates manufacture, parts inventory and repair.

A plurality of tools can be precisely gang mounted. This is accomplished by using a plurality of motor housings, without handles, mounted to a control adapter plate. Such plate is ported to provide pressure control for the respective firing valves.

The modular construction of the tool permits it to be easily disassembled for maintenance, repair, or fastener changeover.

These and other objectives and advantages will become readily apparent from the following detailed description of a preferred embodiment of the invention and from the drawings in which.

Figure 8:
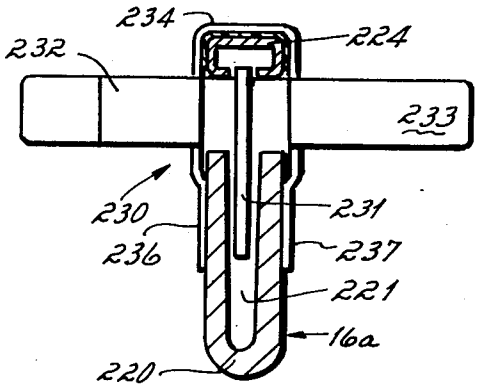
FIG. 8 is a cross-sectional view of a nail magazine taken along lines 8—8 of FIG. 6.
Figure 1:
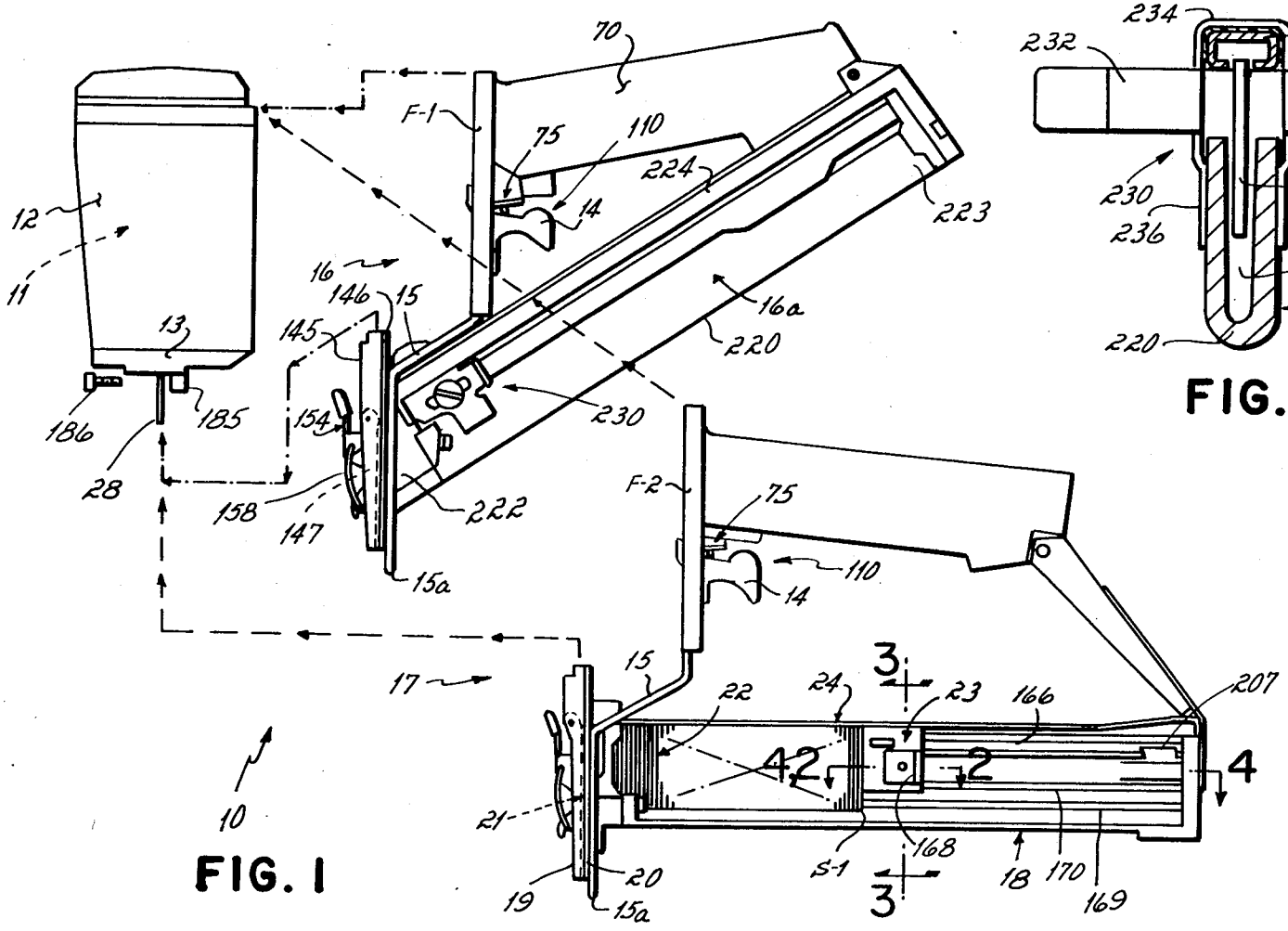
FIG. 1 is an exploded, elevational view of a modular fastener tool according to the invention and showing both nailing and stapling components.

Turning now to the drawings, there is illustratively shown in FIG. 1 a modular tool 10 according to the invention. Modular tool 10 includes an air motor 11 (FIGS. 9 and 10), a motor housing 12, a bottom adapter plate 13, and interchangeable nail and staple magazine and handle assemblies 16 and 17, respectively. Each handle and magazine assembly 16 and 17 includes a handle and a magazine, as shown, and each handle is provided with a forward plate F-1, F-2, respectively. These plates provide support for respective trigger assemblies, and define as well mounting flanges for attachment of the handle and magazine assemblies to the air motor 11. As such, these plates F-1, F-2 and the noted flanges are preferably integral parts of the respective handles. A safety trigger 14, safety 15 and a remote valve (such as valve 75 used in a nailer) are associated with the magazine and handle assemblies 16 and 17. Such a tool 10 is useful, when outfitted with the nail magazine and handle assembly 16, for driving nails into a surface or materials to be nailed together. Alternatively, modular tool 10 is useful, when outfitted with the stapler magazine and handle assembly 17, for driving staples into a surface or materials to be stapled together.

As described, the modular tool 10 utilizes common parts for driving both nails and staples. Specifically, the modular tool 10 utilizes, as common parts, the air motor 11, the air motor housing 12, the adapter plate 13, the safety trigger 14, the safety 15, and the remote valve (such as valve 75). Interchangeable parts, depending on the type of fastener to be driven, include the respective magazine and handle assemblies 16 and 17, which are easily interchangeable with the common elements described above and as will be further described. As noted above, trigger 14, safety 15, and remote valve 75 may be supplied with each magazine and handle assembly, or interchanged therebetween.

AIR MOTOR

Figure 10:
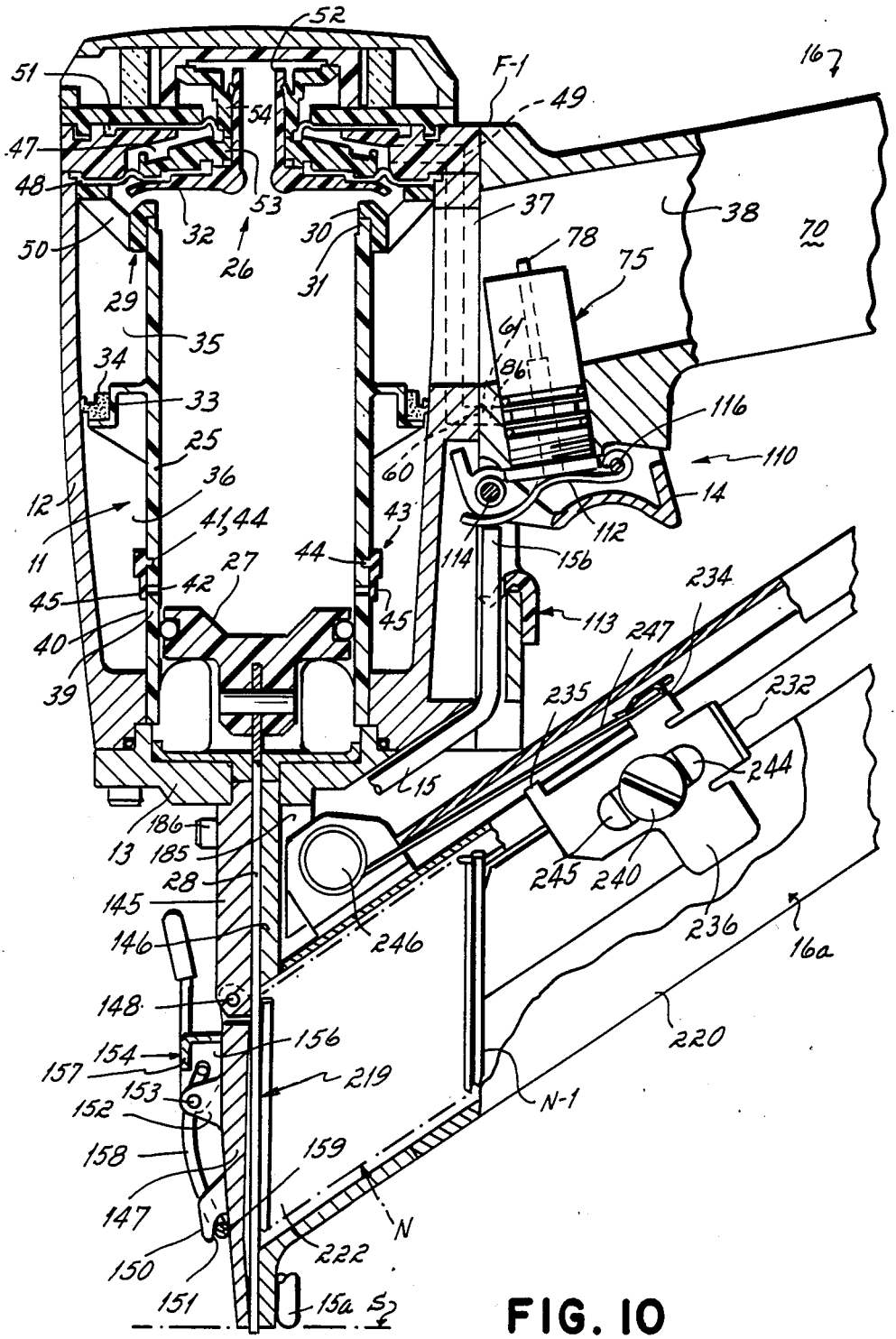

Turning now to a further detailed description of the common components of the modular tool 10 as noted above, it will be appreciated that the air motor 11 includes a cylinder sleeve 25, firing valve 26 and piston 27 as can be clearly seen in FIG. 10. The piston 27 is connected to a fastener driver 28 which reciprocates with the driven piston 27 for the purpose of driving fasteners into a surface.

The firing valve 26 can be of any suitable type, but preferably is of the type which is described in detail in copending U.S. patent application Ser. No. 503,843, filed June 13, 1983, and entitled "Pneumatic Gun Having Improved Firing Valve" by John P. Crutcher. Such application is incorporated herein by reference for illustrative purposes, although not deemed necessary for full and complete understanding of the invention herein.

The air motor 11 further includes a cylinder seal and retainer 29 having an inwardly turned circular flange 30 extending over the annular top end 31 of cylinder sleeve 25. The cylinder sleeve retainer 29 extends radially outwardly to engage the housing 12 and thereby supports the top end 31 of the cylinder sleeve within the housing. Also it will be appreciated that the flange 30, by way of engagement of the top end 31 of the cylinder sleeve 25, retains the cylinder sleeve against upward shifting movement within the housing.

It will also be appreciated that the firing valve 26 includes a diverter 32 which serves as a firing valve seal across the top of the cylinder sleeve retainer 29. This prevents pressurized air from entry into the top of the cylinder sleeve 25 above the piston 27 until such time as trigger 14 is manipulated and pressure air above the firing valve 26 is relieved. Such relief permits the diverter 32 to move away from the cylinder sleeve seal and retainer 29 and, in particular, the inwardly turned flange 30 thereof. Thereafter, when the trigger 14 is released, the increased pressure above the firing valve 26 causes it to shift downwardly. The diverter 32 thus engages the flange 30 of the seal and retainer 29. This component acts as a buffer between the top end 31 of the cylinder sleeve 25, and the diverter 32 and prevents cylinder sleeve chipping and consequent leakage.

Continuing on with the description of the air motor 11, the cylinder sleeve 25 is provided with a radially outwardly directed bracket 33, provided with an annular seal 34 for sealing an annular pressure chamber 35 from a lower chamber 36 within the housing 12. In this regard, it will be appreciated that the chamber 35 communicates through port 37 in the housing 12 with the handle chamber 38 which is constantly pressurized by means of an air fitting at the end of the handle (not shown). It is this pressure which, when admitted to the top of the cylinder sleeve 25, drives the piston 27 downwardly.

The lower end 39 of the cylinder sleeve 25 comprises a smooth cylindrical outer surface 40 having no circumferential groove therein. Cylindrical surface 40 is provided with a plurality of recesses 41 and with a plurality of ports 42 extending completely through the wall of the cylinder sleeve 25. A flat elastic band 43 is provided with projections 44. These are oriented to extend into the recesses 41, and to prevent axial movement of the band along the cylinder sleeve 25. The elastic band 43 has a reduced thickness portion 45 encircling the cylinder sleeve 25 on the surface 40 and covering the ports 42. This band, being elastic, permits air to exhaust from the ports 42 beneath a descending piston 27. Yet, when no air is being forced outwardly through the ports 42, the band portion 45 closes on the ports and prevents the ingress of air from outside the cylinder sleeve 25 into the cylinder sleeve through the ports.

It will be appreciated that the shape of the cylinder sleeve 25 as shown, including the bracket 33, admit of cylinder molds which can be moved axially together for the purpose of molding the cylinder and axially away from each other for releasing the cylinder. Since there are no circumferential grooves required in the cylinder sleeve, it is unnecessary to utilize radially moving molds. Utilization of axially moving molds provides a better casting or parison which retains a round shape and requires either no machining or less machining to insure interior cylinder sleeve roundness.

Figure 9:
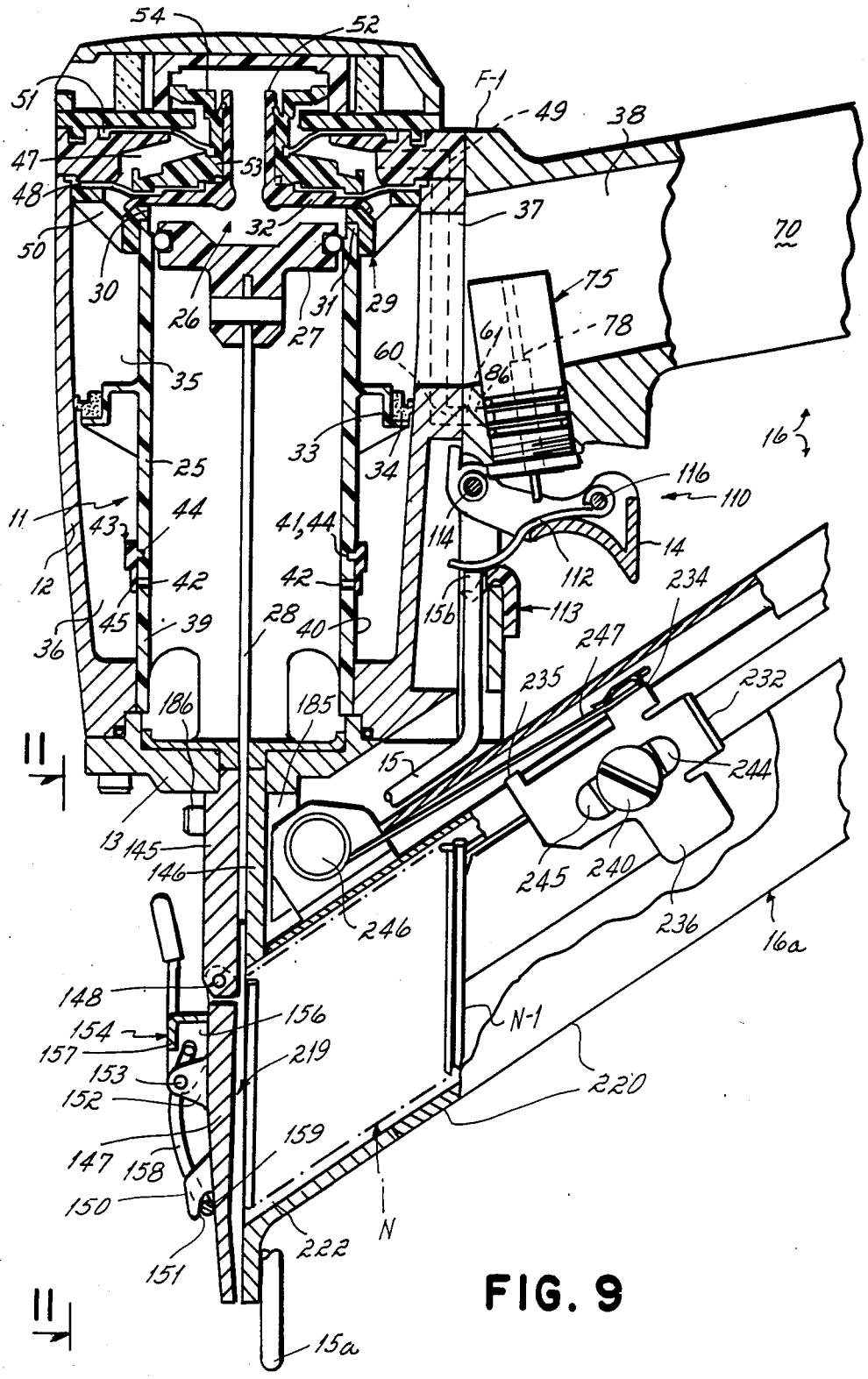
FIGS. 9 and 10 are cross-sectional views of the tool of FIG. 1, in nailing configuration and showing the unactivated and activated positions thereof, respectively.
Figure 13:
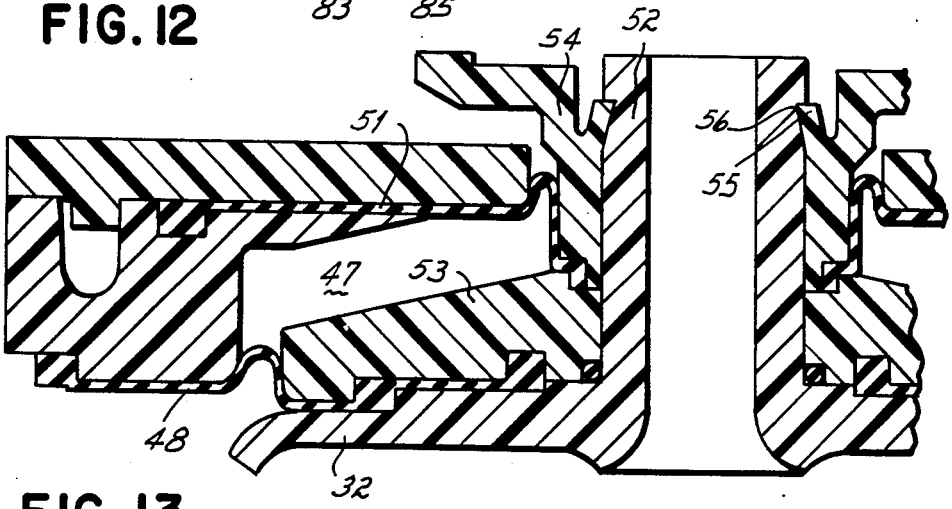
FIG. 13 is an enlarged cross-sectional view of the firing valve of the tool of FIG. 1.

The firing valve used in the air motor 11 is best seen in FIGS. 9, 10 and 13. It will be appreciated that the firing valve can be constructed as similarly to that as disclosed in copending U.S. patent application Ser. No. 503,843, filed June 13, 1983, John P. Crutcher, inventor.

In principle, the firing valve includes the diverter 32 which normally sits on the flange 30 atop the cylinder sleeve 25, all as shown in FIG. 9. This situation continues for as long as high pressure air is present in the chamber 47 surrounding the firing valve above the diverter 32 and the seal 48. Such high pressure air is transmitted to the chamber 47 through the pressurized air passageway 49, as will be further described.

Once the passageway 49 is vented, the high pressure air in the chamber 47 is released and the valve is subjected to a pressure differential which suddenly lifts the firing valve, including the diverter 32, from the top of the cylinder. This admits the high pressure air in the surrounding chamber 35 over the piston for driving it downwardly. This high pressure air in handle chamber 38 has come through the port 37 into the chamber 35 where the high pressure air is transmitted through the passageways 50 located in the cylinder retainer 29. Once the air passageway 49 is pressurized, however, as by releasing the trigger, there is a pressure differential favoring the downward motion of the firing valve so that the diverter 32 seals off the top of the cylinder, permitting the piston to return.

Considering now the details of the firing valve in FIG. 13, it is noted that the firing valve includes the diverter 32, the lower rolling seal 48, the upper rolling seal 51 and firing valve stem 52. A support member 53 is placed over the stem and holds the inward circumferential portion of the seal 48 against the diverter 32. The inward circumferential portions of the rolling seal 51 are held against the member 53 by means of an exhaust valve or firing valve retainer 54. Accordingly, it will be appreciated that the firing valve is a composite made up of a number of different elements which are secured together as noted.

In the past, it has been typical to provide the exhaust valve 54 with threads complementary to threads provided on the firing valve stem 52, whereby the retainer or exhaust valve 54 can be screwed onto the stem for firing valve assembly. In such construction, however, it is necessary to machine threads in both the exhaust valve 54 and the stem 52, and to provide a turning motion of one part relative to the other in the assembly process.

As best seen in FIG. 13, there are no threads on the firing valve stem 52 or on the exhaust valve 54. Instead, the exhaust valve 54 is provided with an inwardly tapered collar 55 which may be slotted at various portions around its periphery to provide some resiliency therein. The firing valve stem 52 is itself provided with inwardly turned detents 56 of complimentary shape to the collar or projections 55. The exhaust valve 54, when the firing valve 26 is assembled, is simply placed over the stem 52 and pressed thereon, pressing together all of the previously described components including the seals 48, 51 and the support member 53. The exhaust valve 54 is pressed over the stem 52 until the projections of collar 55 engage in the detents 56, thereby snapping the exhaust valve 54 onto the valve stem 52 in a permanent position, and holding the firing valve components in a permanent position.

Further considering the function of the air motor 11, and as previously stated, it will be appreciated that the firing valve 26 remains in its normal position as shown in FIG. 9 for so long as pressure is present in the chamber 47. High pressure air is conducted to the chamber 47 through the passageway 49 provided in the housing 12. This passageway 49 terminates in a port 60 which is located in a position to communicate with a port 61 in a handle 70 of a nailer such as that shown in FIGS. 9 and 10.

REMOTE VALVE

Each of the nailer and stapler configurations use a remote valve which is interchangeable therebetween. Due to the fact they are identical, only the remote valve 75 in the nailer will be described. Remote valve 75 is provided in the handle 70 (or in the handle of a stapler) for the purpose of conducting pressurized air through the ports 61 and 60 and passageway 49 to the chamber 47. Alternately, the remote valve may be actuated to vent to the atmosphere the ports 61, 60, and the passageway 49 together with the chamber 47 to initiate actuation of the firing valve 26 and of the air motor 11.

Figure 12:
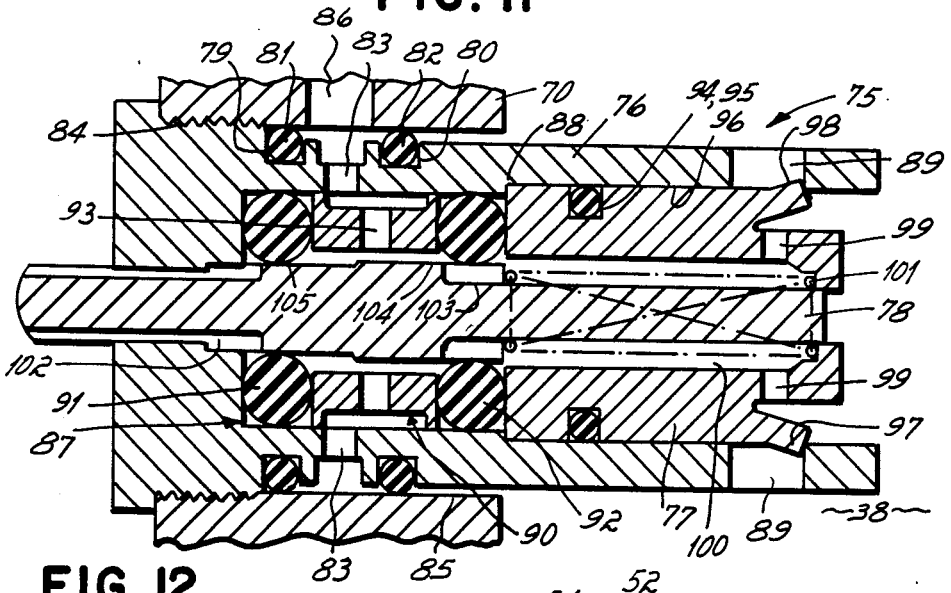
FIG. 12 is a cross-sectional view showing the remote valve of the tool of FIG. 9.

While FIGS. 9 and 10 show the general orientation of the remote valve 75, the details of the remote valve are best seen in FIG. 12. The remote valve includes a housing 76, an insert 77 and an actuator stem 78. The housing 76 is provided with grooves 79 and 80, accommodating respective O-rings 81 and 82, surrounding the housing. A plurality of ports 83 are spaced around the housing wall and extend therethrough in an area between the grooves 79 and 80. The lower end of the housing 76 is threaded, as at 84, and thus can be screwed into an opening or bore 85 in a handle 70, for example, of a nailer such as shown in FIGS. 9 and 10 (or in the handle of a stapler as at 17 in FIG. 1). The bore 85 extends through the handle into the high pressure air chamber 38. The O-ring seals 81 and 82 serve to seal the housing 76 to the handle 70 within the bore 85, serve to seal off the passageway 86 from the high pressure chamber 38 in the handle 70, and serve to seal against leakage to atmosphere through threaded end 84 of housing 76. Passageway 86 extends through handle 70 and between the remote valve 75 and the air passageway 49, and is connected to such passageway via ports 61 and 60, as noted in FIG. 10.

The housing 76 is further provided with a relatively smooth, internal bore 87 which may be slightly stepped as at 88 to provide a seating surface for the insert 77. Apart from this step 88 and the recesses 89 at the upper end of the housing 76, the housing 76 has a relatively smooth interior surface, free from circumferential machined grooves, seats, and the like. Located within the bore 87 is a circumferential spacer 90 which extends around the stem 78. O-ring seals 91 and 92 reside above and below the spaces, also circumferentially around the stem 78. Spacer 90 includes a plurality of ports 93, for passing pressurized air around the stem immediately adjacent the spacer through the ports 83 and to the passageway 86, and alternatively for venting the passageway 86 through the ports 83 and the ports 93, depending on the position of the stem 78, as will be described.

The insert 77 has a groove 94 provided with an O-ring seal 95 for sealing the insert to the bore 96, which is a continuation of the bore 87 of the housing 77. The insert also has turned out projections 97, 98 which reside in recesses 89 when the insert 77 is pressed into the bore 96. The insert 77 is provided with a plurality of ports 99 communicating between the chamber 38 of handle 70 and a chamber 100 immediately surrounding the stem 78 internally of the insert. A spring 101 is placed between the stem 78 and the upper end of the insert 77 in order to constantly bias the stem in a direction which is to the left, as viewed in FIG. 12.

It will be appreciated that the stem 78 has a plurality of surface discontinuities. For example, the stem 78, as shown in FIG. 12, has either a fluted or a turned down portion 102 at its lower end, and a fluted or turned down portion 103 at its upward end in the area of the spacer 90 and seal 92.

It will be appreciated that when the stem 78 is extended by the spring 101 to its downwardmost position, the stem 78 engages the O-ring seal 91 and seals off the chamber 100 surrounding the stem 78 so that no pressurized air can escape along the reduced portion 102 at the lower end of the stem 78. At the same time, it will be appreciated that chamber 100 communicates through the ports 93 and 83 with the passageway 86 leading to the firing valve, as has been described. High pressure is available in the chamber 100 through the ports 99 and the high pressure chamber 38 in the handle 70 of a nailer, for example.

When it is desired to drive a fastener, the stem 78 is actuated in a upward direction, or in a direction to the right as viewed in FIG. 12, against the bias of spring 101. This action causes stem portion 104 to move upwardly against O-ring 92 and thereby seals off the chamber 100 from the ports 93. At the same time, stem portion 105 is moved to the right or upwardly and unseats from the seal 91. Any pressurized air present at the ports 93 can be exhausted to atmosphere through the lower portion of the remote valve 75 via the reduced portion 102 of the stem 78. Accordingly, the passageways 86 and 49 are vented, together with chamber 47, through the remote valve 75. This permits the firing valve 26 to quickly lift from the retainer seal 29 of cylinder sleeve 25 for driving of the piston as has been described.

It will be appreciated that the internal bores of the housing 76 are relatively smooth and do not require any special machining for valve seating. It will also be appreciated that all sealing within the remote valve 75 occurs as a result of the assembly of the seal 91, the spacer 90, the seal 92 and the insert 77, together with the stem 78 within the housing 76. The insert, and specifically its projections 97 and 98 cooperating with the recesses 89, serve to press the seals 91 and 92 and the spacer 90 together to provide the necessary sealing. Accordingly, it will be appreciated that the remote valve 75, when in its normal condition as shown in FIG. 12, transmits pressurized air in the handle 70 of a pneumatic tool to above the firing valve in order to maintain the tool in an inoperative condition. The remote valve may be actuated to cut off the high pressure air above the firing valve and to vent the chambers above the firing valve in order to actuate the firing valve in the air motor 11 for driving a fastener.

TRIGGER

Turning now to a description of the trigger for actuating the remote valve 75, attention is directed to FIGS. 9, 10, 14 and 15, wherein a trigger assembly 110 is illustrated. The trigger for each of the nailer and stapler is identical and for purposes of brevity, only the trigger associated with a nailer will be described. The stapler trigger is mounted on plate F-2 just as the nailer is mounted with respect to plate F-1. Trigger assembly 110 includes a manually operable trigger lever 14, a safety interlock lever 112, and a trigger cover or retainer 113. As shown in the drawings, the trigger lever 14 is pivoted at the pin 114 and is biased about pin 114 by the spring 115, as viewed in FIG. 14. A pin 116 is mounted through the trigger lever 14. Safety interlock lever 112 is pivoted to trigger lever 14 by pin 116 and is biased by spring 117, as viewed in FIG. 14.

Figure 14:
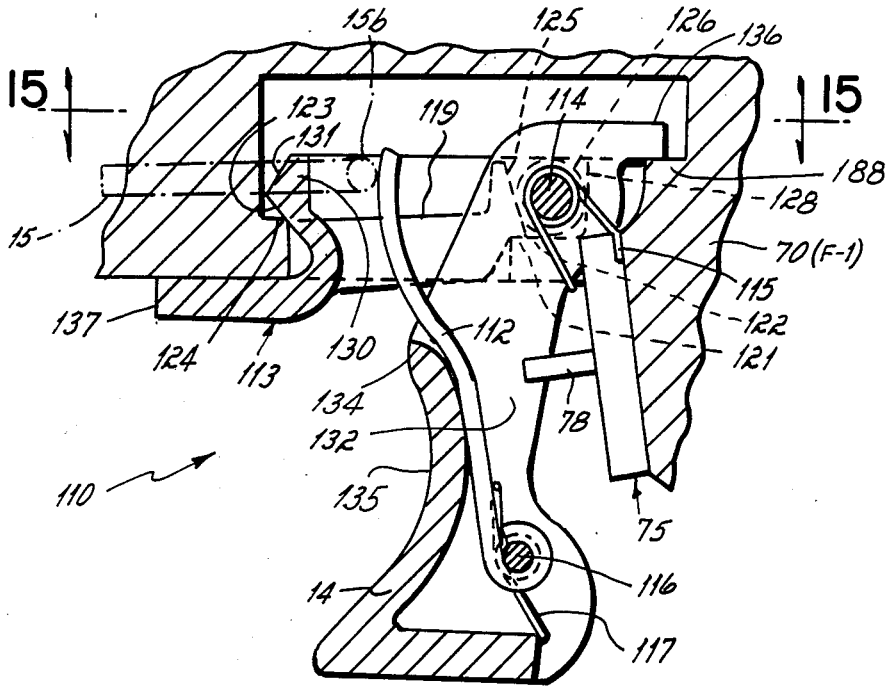
FIG. 14 is a cross-sectional view of the snap-in trigger of the tool of FIG. 1.

The trigger retainer 113 is provided with latch members on each side thereof. In particular, the trigger retainer 113 includes two upwardly extending legs 119 and 120, each of which have a latching surface 121, as indicated by the hidden lines in FIG. 14. This latch surface 121 is designed for cooperation with the lug 122, also shown in dotted lines in FIG. 14. When the latch surface 121 is positioned above the lug 122 as shown in FIG. 14, the trigger retainer 113 is held at the ends of legs 119, 120 within the forward plate F-1. Retainer 113 also includes a latching surface 123 at the lower end thereof which extends downwardly and is yieldable for cooperation with abutment 124 of forward plate F-1. Thus, the latch surfaces 121 and 123 engage the lug 122 and abutment 124 respectively to secure the retainer 113 in place within the plate F-1.

The retainer 113 also includes at the end of each leg an upstanding pin retaining surface 125. Surfaces 125 of the respective legs 119 and 120 serve to engage the respective ends 126 and 127 of pin 114 and retain the pin 114 in place against surfaces 128 and 129, respectively, of the forward plate F-1.

Figure 15:
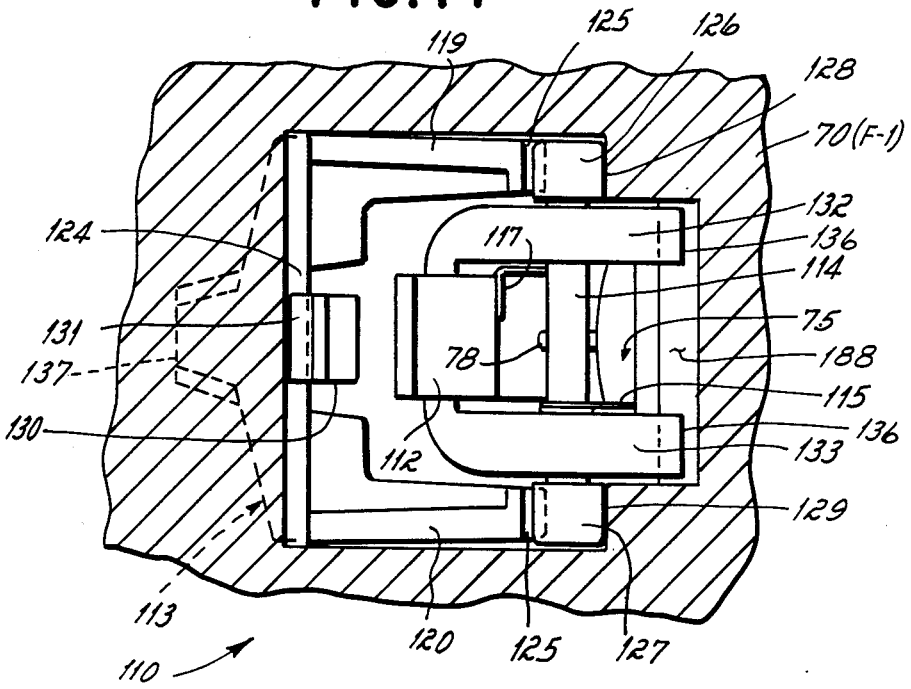
FIG. 15 is a cross-sectional view, taken along lines 15—15 of FIG. 14.

As shown in FIG. 15, the forward end of the retainer 113 includes an upstanding lug 130 which is provided with a cam surface 131 thereon. When the trigger retainer 113 is snapped into place, the cam surface 131 engages the forward plate F-1 and causes the lug 130 to move inwardly until it can snap over the abutment 124 where surface 123 is engaged to retain the retainer in place.

Returning momentarily to trigger lever 14, it will be appreciated that the trigger lever has two upstanding sides, 132 and 133 (FIGS. 14 and 15) through which the pin 116 is mounted. It will also be appreciated that the interlock lever 112 extends between these sides and then drops through the trigger lever 14 at the termination area 134 of the manually engageable surface 135 thereof. The walls or sides 132, 133 are extended to form stop lugs such as at 136 (FIG. 14) to limit clockwise movement of the trigger lever 14.

It will be further appreciated that the entire trigger assembly 110 can be easily removed from the tool by means of lifting the lower end 137 of the retainer 113 outwardly from the forward plate F-1. This causes a slight pivoting of the lug 130 by virtue of the engagement of the cam surface 123 on abutment 124 and permits the retainer to be pivoted rearwardly and away from the forward plate F-1. Once the lower end of the retainer 113 clears the forward plate F-1, the surface 121 can be pulled downwardly to clear the lug 122 and the retainer completely removed. This permits the pin 114 to be pulled downwardly and away from the forward plate F-1 over the lugs 122 and thus the entire trigger assembly 110 is easily removable from the tool. This clears an access for the remote valve 75 which can then be easily serviced or replaced as needed. Moreover, it will be appreciated that this permits the same trigger assembly 110 to be utilized for each different type of fastener magazine and handle combination to be used with air motor 11.

SAFETY

Figure 11:
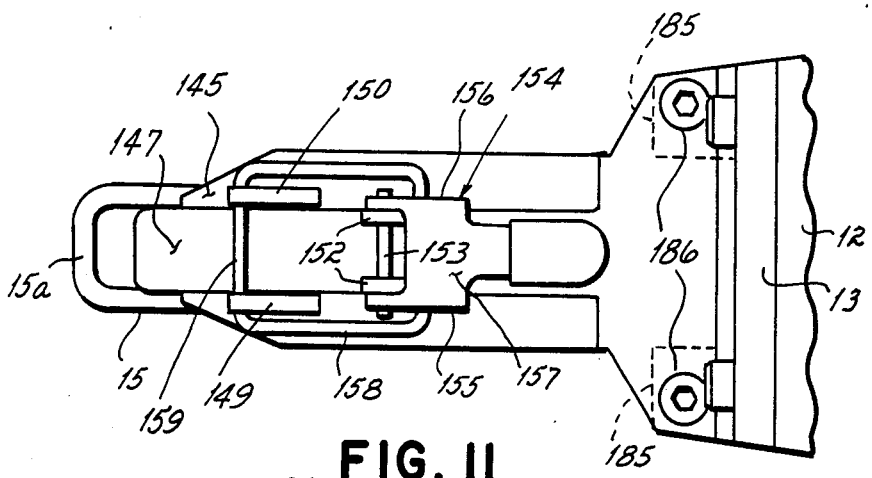
FIG. 11 is an elevational view, taken along lines 11—11 of FIG. 9, and showing the access door to the tool's driving station.

As perhaps best seen in FIGS. 1, 9 and 10, the modular tool 10 is provided with a safety 15 which is identical for both nailer or stapler. Safety 15 comprises a formed wire safety member which extends downwardly from the housing 12 and adapter plate 13. The bottom most end 15*a* of the safety 15 is extended to such a distance as to project outwardly from the bottom-most area of the back and front plates of the magazines, as will be described. It will be aprreciated that the formed wire safety 15 may extend down both sides of the magazine, forming a transverse bight at the lower end 15*a* (FIG. 11). Also, at the upper end of the safety 15 the formed wire extends upwardly into forward plate F-1 (a F-2 if a stapler is considered) and is held for reciprocal movement therein with the upper end of the safety 15 forming a bight 15*b* extending in a transverse direction for engagement of the bight with the safety interlock lever 112.

Returning to FIGS. 9 and 14, it will be appreciated that the when the modular tool 10 is in its at-rest condition, such as shown in FIG. 9, the bottom end 15*a* of the safety 15 projects below all other structure associated with the tool and thus the upper end or bight 15*b* is in its lowermost position with respect to the trigger. In this position, even if the trigger level 14 is manually actuated, the air motor 11 will not function in view of the fact that the interlock lever 112 cannot be moved to the extent required for engagement with the stem 78 of the remote valve 75. Thus, the air motor cannot be operated unless the tool is placed adjacent a surface, such as a surface S (FIG. 10), to be stapled or nailed.

When the tool 10 is moved against as surface S, such as shown in FIG. 10, the lower end 15*a* of the safety 15 engages the surface and is pushed upwardly. This moves the bight 15*b* upwardly a similar distance to a point where the safety interlock lever 112 is touching or is just below the stem 78. Thereafter, manual actuation of the trigger lever 14 in a counter-clockwise direction serves to further lift the safety interlock lever 112 against the stem 78 and to move the stem 78 up into the remote valve 75, thereby releasing high pressure air from above the firing valve 26 and venting the firing valve through passageway 49 and the remote valve 75 to permit the firing valve 26 to lift off the cylinder seal 29 and thus allowing high pressure air to act against the piston 27, driving it and the driver 28 downwardly to drive a fastener.

DRIVE STATION ACCESS DOOR

As previously noted, the modular tool 10 is useful with a number of different fastener magazines and types of fasteners. Nevertheless, each of the fastener magazines is preferably provided with a front plate and a rear plate which define a path for the fastener driver and as well a driving station for each fastener just before it is driven. Each of the magazines also includes an access door to the driving station for the purpose of permitting jam clearance and the like. While it will be appreciated that the shape or size of the access door and its associated latching mechanism may vary according to the respective magazines, each of the access doors must be held positively in place by its associated latching apparatus so as to provide a precisely defined and unchanging driver path and fastener drive station. In this regard, it is has been noted that access doors in the past have either fitted loosely from their inception or wear loose. According to the invention, however, an access door and a latching apparatus are provided in each of the respective magazines for securely fastening the access door in a precise position. Any wearing of the latching parts or of the access door is accommodated by the specific latching structure so that the latching apparatus tends to wear in rather than to wear out and become loose.

The specific access door and latching mechanism according to a preferred embodiment of the invention in shown in FIGS. 9, 10 and 11. In FIG. 10, it will be appreciated that the modular tool 10 is shown set up for use as a nailer having a magazine and handle assembly 16 and including a front plate 145 and a back plate 146. The front plate 145 is provided with an access door 147 pivoted by a pin 148 to the front plate. The front plate 145 includes two downwardly depending cam lugs 149 and 150 having tapering surfaces 151 (FIG. 10). The access door 147 is provided with upstanding lugs 152 mounting a pin 153 about which latching lever 154 is pivoted. Latching lever 154 has downwardly turned sides 155 and 156 which are adapted, such as by drilling, to retain the upper bight portion 157 of a resilient spring latching bail 158. Bail 158 has a lower bight portion 159. As will be appreciated from FIG. 10, the upper and lower bight portions have axes which are disposed inwardly toward the access door 147 from the pin or pivot 153 when the latch is closed. Thus, the latch comprises an over-center latch which tends to remain in the locked condition as shown. When it is necessary to open the access door 147, it is only necessary to pull the latching lever 154 downwardly or in a counter-clockwise direction as viewed in FIG. 10, thereby lifting the bight portion 157 and moving it forwardly so as to permit the lower bight portion 159 to be removed from the tapered cam surfaces 151 of the lugs 149 and 150.

In FIG. 11, it will be seen that the bight portion 159 extends between the lugs 149 and 150 mounted on the front plate 145 and engages the rear surfaces of the access door 147, maintaining the door closed. When the bight 159 is wedged between the access door 147 and the cam surfaces 151 of the lugs 149 and 150, it will be appreciated that the access door 147 is urged into a closed position. As the bight portion 159 or other components of the latching apparatus wear, the bight portion 159 is simply pulled slightly further inwardly along the tapered surfaces 151, thereby continuing to maintain the access door 147 in a precisely positioned, locked condition. Moreover, it will be appreciated that the resiliency afforded by the curved latch bail 158 maintains a spring tension on the bight portion 159, tending to urge it inwardly and thereby provide a constant spring bias retaining the latch door 147 in a closed position.

It will be appreciated that while the access door and latch associated with the modular tool, when set up as a nailer, has been described, the access door and latch for staples, or other types of fasteners as suitable, can be similarly constructed and used.

STAPLE FEED MOTOR

When set up as a stapler utilizing a staple magazine and handle assembly 17 (FIG. 1), the invention provides an improved staple feed motor for the purpose of urging staples forwardly to a drive station beneath the driver 28. In this connection, a staple magazine such as at 18 (FIG. 1) includes forward and rearward backing plates 19 and 20, respectively, for attachment to the adapter plate 13 of the housing 12 and defined therebetween a drive station 21 generally disposed as shown. A plurality of staples 22 is urged forwardly by carriage 23 toward such drive stations, the staples being covered by a pivotable staple cover 24 and retained thereby from falling out of the magazine 18.

Figure 3:
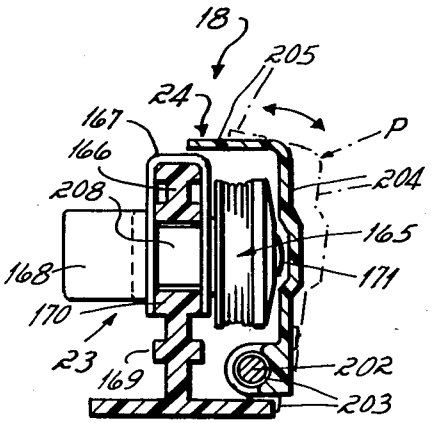
FIGS. 2–4 are respective cross-sectional views of a feed motor for a staple magazine, FIGS. 3 and 4 further showing details of a top loading staple magazine.
Figure 2:
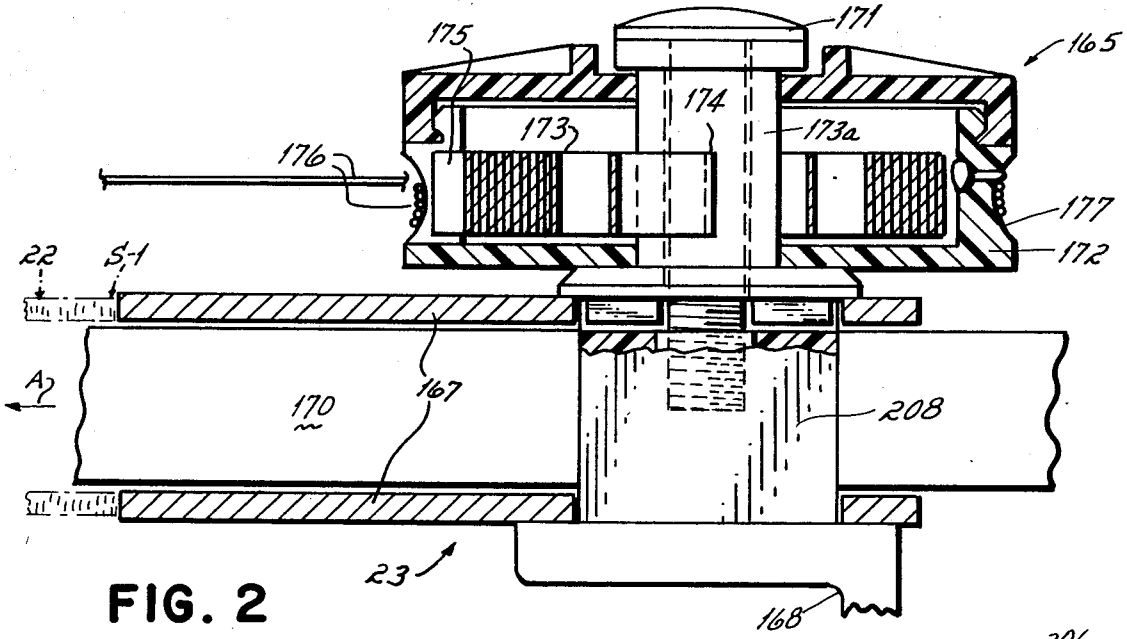
Figure 4:
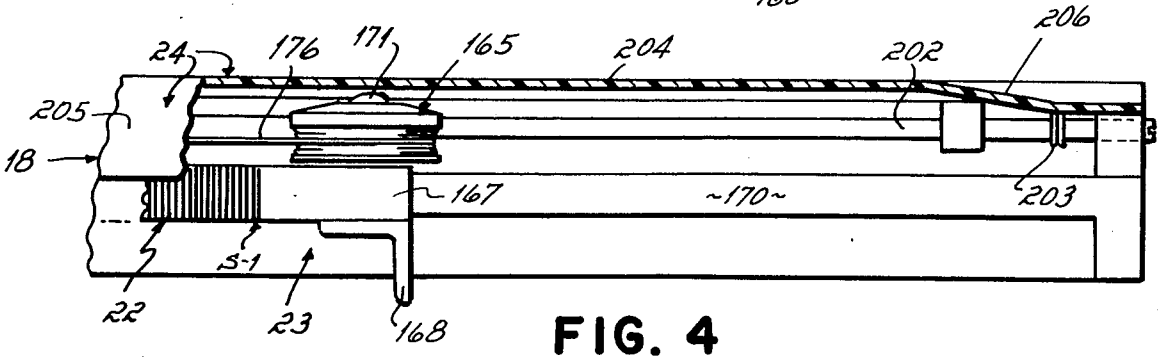

Turning now to FIGS. 2–4, the details of the carriage 23 and the drive motor 165 will be described. The staple magazine 18 includes a staple rail 166 on which the staples 22 are disposed for sliding movement in the direction of arrow A as shown in FIG. 2. The carriage 23 includes a U-shaped staple follower or pusher 167 also fitting over the rail 166 for engaging the last staple S-1 in a line of staples 22. Attached to the carriage 23 and more particularly to the follower 167 is a manually operable tab 168 which can be engaged and pulled rearwardly for the purpose of insertion of additional staples into the magazine 18. The magazine 18 may include further guide members 169 and 170, for example, for the purpose of guiding staples on the rail 166 and for the further purpose of structural rigidity of the entire magazine 18.

Secured to the carriage 23 by means of a bolt 171 threadably engaged with the body of the tab 168 is the staple feed or drive motor 165. This drive motor includes a pulley 172 surrounding a flat coil spring 173 secured to a post **173*a* at a spring end 174. The other end of the spring is secured, as at 175, to the pulley 172. A cable 176 is secured to a forward end of the magazine and is wrapped about the pulley in groove 177. When the tab 168 is engaged and pulled rearwardly, the pulley unwinds as a result of its attachment to the cable 176 as the pulley moves rearwardly. Such unwinding tends to coil up or tighten tha flat spring 173. Thereafter, staples are loaded on rail 166 and the carriage is released to engage the last staple S-1 in a line of staples 22, thereby urging the entire group of staples forwardly toward the drive station 21. This particular construction of a feed motor eliminates the winding and unwinding of the heretofore used flat constant force spring which, due to its extension from a spring housing, was constantly being subject to the elements and the ambient environment of the stapler. Utilization of the pulley 172 secured to the carriage 23 and surrounding the motive spring maintains the drive in a cleaner and more smoothly functioning condition. Also, all of the drive elements can be mounted to the side of the magazine rather than on the top thereof to provide for top loading of staples onto the rail 166**.

TOP LOAD STAPLE MAGAZINE

The specific details of the top loading staple magazine 18 according to the invention are best seen in FIGS. 1–4.

Magazine 18 is provided with a pivotable cover 24, rotatably pinned at a rear end of magazine 18 at pin 202 (FIGS. 3 and 4). The forward end of cover 24 is similarly and coaxially pinned to magazine 18 at a forward end thereof, such pin, however, not appearing in the drawings. A spring 203 urges cover 24 in a counterclockwise direction as viewed in FIG. 3.

Cover 24 includes a side portion 204 and a top portion 205. When the cover is in its normally closed condition, portion 205 covers at least a portion of rail 166 and prevents any staples from moving off the rail, even when the tool 10 is turned upside down.

Side portion 204 of cover 24 is generally straight in a direction from a forward end of the magazine rearwardly. Near the rear end of magazine 18, however, side portion 204 tapers inwardly, as at 206, toward rail 166.

In FIG. 3, it will be appreciated that side portion 204 of cover 24 is sufficiently spaced from the follower motor pulley 172 so that the follower apparatus may freely move along rail 166. When it is desired to load additional staples onto rail 166, tab 168 is manually grasped and pulled rearwardly. This moves pulley 172 rearwardly where it engages inwardly tapered portion 206 of cover 24 and cams the entire cover outwardly to a piston P, as shown in the dotted lines of FIG. 3. In this position, top portion 205 of cover 24 is moved to the side of rail 166, and adequate clearance is provided for placing additional staples in rail 166. Once this is completed, follower 167 (FIGS. 2 and 4) is released to push the staples on rail 166 in a forward direction. When pulley 172 clears tapered portions 206 of cover 24, the cover is spring biased back into operative position as shown in solid lines in FIG. 3.

As shown in FIG. 1, a follower catch slot 207 is provided in rail 166 at a rearward end thereof. When the follower is pulled rearwardly for loading, and to a position where cover 24 is cammed open, element 208 of the follower apparatus can be urged upwardly into slot 207, thus holding the entire follower apparatus rearwardly, and cover 24 cammed open, for loading. Thereafter, the tab 168 is pushed downwardly, element 208 clears slot 207, and the follower 167 engages the rearwardmost of the newly loaded staples on rail 166. At the same time, pulley 172 clears tapered portion 206 of cover 24, permitting the cover 102 to close.

Accordingly, the invention provides a top loading magazine from which staples cannot inadvertently fall even when the tool 10 is operated in an inverted position.

NAILER MAGAZINE AND FOLLOWER

Details of the nail magazine 16a and nail follower apparatus are best seen in FIGS. 1 and 5–8.

Magazine 16a includes a nail magazine body 220 defining an elongated nail receptacle or nail path 221 for receiving and guiding a strip N of nail fasteners (FIG. 5) having a rearwardmost nail N-1. Nail strip N may be any commonly known pre-assembled, temporarily integral strip of nails as is well known in the industry.

Path 221 is open at its forward end 222 and is in communication with drive station 219, similar to drive station 21 of the staple tool described herein, excepting of the appropriate configuration for nails as opposed to staples. Drive station 219 is defined by front plate 145 and rear plate 146 of magazine 16a. A drive station access door 147 is also provided having a latch means like that described above with respect to the staple magazine. Path 221 is also open at its rearward end 223 for receiving a strip of nails therein for loading. Body 220 is operatively associated with and connected to frame 224 for connection to handle 70, the frame 224 also provides guide or support structure for the nail follower apparatus to be described.

Figures 5, 6, 7:
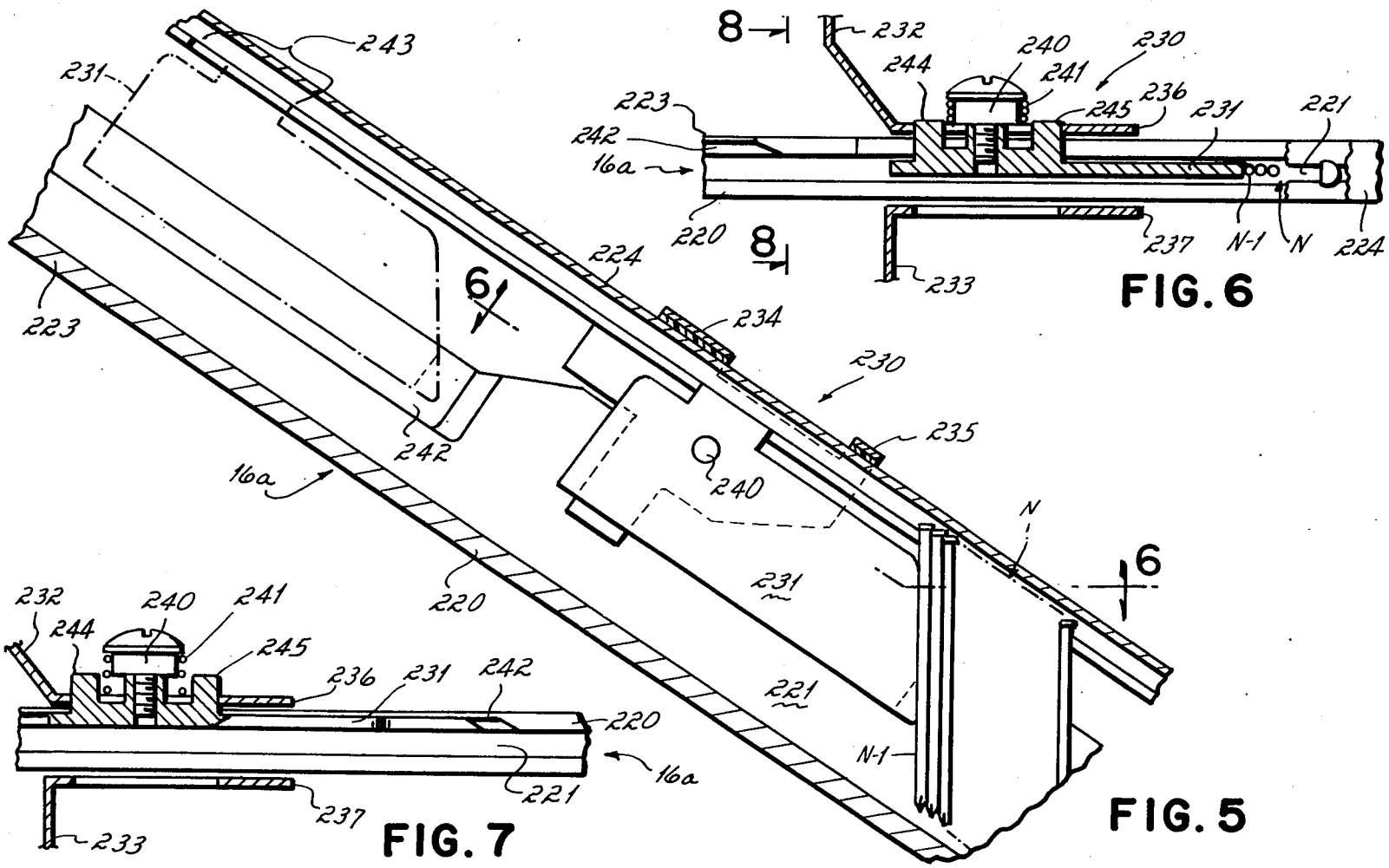
FIG. 5 is a cross-sectional side view of a nail magazine and follower apparatus according to the invention.
FIG. 6 is a cross-sectional view taken along lines 6—6 of FIG. 5.
FIG. 7 is a cross-sectional view similar to FIG. 6, but showing the follower in a loading condition.

In FIG. 5, a follower 230 has mounted thereto a follower blade 231. Tabs 232 and 233 on follower 230 can be grasped to pull blade 231 rearwardly for loading.

Follower 230 includes top guides 234 and 235 disposed in sliding relationship with frame 224 to guide follower 230 in reciprocal directions back and forth along body 220. Follower 230 also includes side guides 236, 237 slidably engaging outer sides of body 220 to assist in slidably mounting follower 230 on magazine 16a. Guides 234–237 may be integrally formed with tabs 232, 233 to form an integral follower 230.

Blade 231 is mounted to follower 230 for movement therewith within nail path 221. In addition, blade 231 is mounted to follower 230 for transverse movement as best seen in FIGS. 6 and 7. A screw 240 is threaded to blade 231 and is spring loaded by spring 241 against side guide 236. Spring 241 normally urges blade 231 against the side of path 221 and to the top as viewed in FIGS. 6 and 7. Screw 240 thus mounts the blade 231 to the follower 230. Also, blade 231 is provided with transversely extending projections 244 and 245 which extend outwardly from magazine body 220 and slidably between frame 224 and body 220 (FIGS. 6 and 7) to serve as blade guides.

A recess 242 is provided in magazine body 220 and a slot 243 is provided in frame 224. Recess 242 and slot 243 are disposed, generally, near rearward end 233 of the magazine 16a, and accommodate portions of the blade 231 when it is pulled rearwardly for nail loading, as will now be described.

In use, follower 230 is attached to a constant force spring 247 housed in housing 246 (FIG. 1) for pulling follower 230 forwardly and against last nail N-1 of a strip N of nails. This biases nails serially into the drive station 219. When it is desired to load additional nails, tabs 232, 233 are grasped and the follower 230, together with blade 231, is pulled rearwardly. Blade 231 blocks nail path 221 until the blade 231 moves rearwardly to a point adjacent recess 242 and the blade portion supporting projections 244 and 245 is adjacent slot 243. At this point, spring 241 urges the blade 231 into recess 242. The portions of blade 231 supporting projections 244, 245 fall sideways into slot 243.

In this position, transversely removed from path 221, the follower blade 231 does not block the rear end of path 221 and a strip N of nails can be loaded from the rear end 223 of magazine 16a into the recess or path 221 and past blade 231. Once the strip N of nails is loaded, screw 240 is pushed inwardly to release blade 231 from recess 242 and slot 243. The follower 230, with blade 231 now in path 221, moves forwardly with blade 231 engaging the last nail N-1 to push the entire nail strip N forwardly to drive station 219 where the nails can be serially driven.

Also, it will be appreciated that the blade 231 positively engages and holds the last nail N-1 in the drive station 219. There are no transverse recesses for blade 231 at the drive station 219 and thus the last nail is positively held, with no chance of tilting or falling backwards along path 221 in the magazine. At the same time, the rearward transverse recess 242 and slot 243 receives blade 231 to clear path 221 for loading.

Accordingly, nails can be loaded from the rear end of magazine 16a without removal of the follower rearwardly from the magazine.

MODULAR TOOL

Returning now to the modular aspects of the tool 10, it will be appreciated that each of the magazines and handle assemblies 16 and 17 are easily and interchangeably secured to the housing 12 by means of the adapter plate 13 and respective forward plates F-1, F-2. Specifically, the adapter plate 13 further includes a depending lug 185 and provides means by which the front and back plate of a magazine, such as the front plate 145 and the back plate 146 of a nailing magazine as shown in FIG. 10, can be secured to the bottom of a housing 12 in the adapter plate 13 by means of the bolt 186. The upper ends of the front and back plates 145, 146 extend upwardly into the adapter plate 13 for rigidity purposes. Also, it will be appreciated that the handles for the respective magazines, such as the handle 70 as shown in FIGS. 9 and 10, are secured to the housing 12 by any appropriate means such as bolts (not shown) extending into the housing casting from the flanges of plates F-1 or F-2. In this regard, it will be appreciated that the handle 70 provides a stop abutment 11 (FIG. 14) for engagement by the stop lug 136 of the trigger lever 14. The handle for the staple magazine and for the magazines of any other fasteners are similarly constructed so as to be easily attachable to the housing 12, the remote valves 75 being supplied with each handle but also being interchangeable as between the respective handles.

It will also be appreciated with respect to the nailing magazine and handle assembly 16 that the nail magazine extends upwardly from the horizontal in the range of 30° to 45°, while the handle extends upwardly in the approximate range of 5° to 20° from the horizontal, i.e., from the perpendicular to the drive axis as defined by the fastener driver 28 and the axis of the cylinder sleeve 25 of the air motor 11.

At the same time, it will be appreciated that the handle and magazine of the staple assembly 17 extend approximately perpendicularly to the drive axis as defined by the fastener driver 28 and the longitudinal axis of the cylinder sleeve 25.

Accordingly, it will be appreciated that the modular tool 10 provides a tool for the driving of the nails or staples for other types of fasteners without the loss of the particular configurations of the handles and magazines for nailing or stapling, respectively, while at the same time providing a secure safety together with a large number of interchangeable parts which are utilized for the modular tool 10, irrespective of whether set up to to drive nails or staples.

These and other advantages and modifications will become readily apparent to those of ordinary skill in the art without departing from the scope of this invention, and the applicant intends to be bound only by the claims as appended hereto.

It will be understood by anyone skilled in the art that, in use, tool 10 can assume any orientation. Thus, terms such as upper, lower, downwardly, upward, and the like, used herein and in the claims, are used in association with the accompanying figures solely for purposes of clarity of description.

We claim:

1. A modular pneumatic tool for selectively driving fasteners such as staples and nails from respective magazines therefor, and comprising:

an air motor including a cylinder, piston, and firing valve;

a fastener driver means, operably connected to said piston, for driving fasteners;

an air motor housing confining said air motor and having an open end with said fastener driver means extending therethrough;

at least one fastener magazine having forward and rearward ends;

at least one handle having a forward end and a rearward end;

said magazine and said handle being attached together at respective rearward ends thereof and independent of each other at said forward ends thereof;

a mounting plate disposed on a forward end of said handle and adapted to operably interconnect said handle with said air motor and air motor housing;

said mounting plate and said forward end of said handle being releasably secured to a side of said air motor housing;

an adapter plate means mounted on an underside of said housing and closing off said open end thereof, said driver means extending therethrough, said adapter plate including means on an exterior surface thereof for operatively receiving and attaching said respective nail and staple magazines thereto in an operative position for serially feeding respective fasteners to a position defining a driving station beneath said driver means from which said fasteners can be driven by said driver means extending through said adapter plate; and a forward end of said respective magazines being mountable to said adapter plate means.

2. A modular pneumatic tool as in claim 1 wherein each of said respective magazines includes a front plate and a back plate and wherein said receiving and attaching means on said exterior surface of said adapter plate means includes a depending projection for securing said front and back plates thereto.

3. A modular pneumatic tool as in claim 1 wherein said mounting plate is provided with recess means configured for operatively receiving a removable trigger means for operating said air motor.

4. A modular pneumatic tool as in claim 1, further including a plurality of magazines and attached handles for selective attachment to said air motor, at least one magazine operatively holding nails and another magazine operatively holding staples.

5. A modular pneumatic tool as in claim 4, further including a nail magazine having a back plate operatively secured to said adapter plate means, said back plate of said nail magazine being weldless.

* * * * *

UNITED STATES PATENT AND TRADEMARK OFFICE

CERTIFICATE OF CORRECTION

PATENT NO. : 4,688,710

DATED : August 25, 1987

INVENTOR(S) : Donald J. Massari and Robert J. Hail

It is certified that error appears in the above-identified patent and that said Letters Patent is hereby corrected as shown below:

Col. 5, line 44, insert "prevents" before --cylinder sleeve chipping--.

Col. 11, line 17, "spaces" should be --spacer--.

Col. 12, line 30, insert "trigger" between --nailer-- and --is--.

Col. 15, line 66, "tha" should be --the--.

Col. 16, line 47, "in" should be --on--.

Col. 16, line 60, "the tab" should be --tab--.

Col. 17, line 52, "233" should be --223--.

Col. 18, line 44, "11" should be --188--.

Signed and Sealed this

Second Day of February, 1988

*Attest:*

DONALD J. QUIGG

*Attesting Officer*

*Commissioner of Patents and Trademarks*